United States Patent [19]

Booth et al.

[11] Patent Number: 5,042,404

[45] Date of Patent: Aug. 27, 1991

[54] METHOD OF RETAINING SULFUR IN ASH DURING COAL COMBUSTION

[75] Inventors: Richard C. Booth, North Huntingdon; Bernard P. Breen, Pittsburgh, both of Pa.; Roger W. Glickert, Washington, D.C.

[73] Assignee: Consolidated Natural Gas Service Company, Inc., Pittsburgh, Pa.

[21] Appl. No.: 576,980

[22] Filed: Sep. 4, 1990

[51] Int. Cl.[5] ..... F22D 1/00

[52] U.S. Cl. ..... 110/347; 110/260; 110/266; 431/284

[58] Field of Search ..... 110/260, 261, 347, 262, 110/266; 431/283, 284

[56] References Cited

U.S. PATENT DOCUMENTS

| | | | |
|---|---|---|---|
| 4,232,615 | 11/1980 | Brown | 110/342 |
| 4,285,283 | 8/1981 | Lyon et al. | 110/347 |
| 4,308,808 | 1/1982 | Brown | 110/342 |
| 4,407,206 | 10/1983 | Bartok | 110/347 |
| 4,542,704 | 9/1985 | Brown et al. | 110/347 |
| 4,572,084 | 2/1986 | Green et al. | 110/261 |
| 4,582,005 | 4/1986 | Brown | 110/347 |
| 4,669,399 | 6/1987 | Martin et al. | 110/347 |
| 4,779,545 | 10/1988 | Breen et al. | 110/212 |
| 4,780,136 | 10/1988 | Suzuki | 110/347 X |
| 4,848,251 | 7/1989 | Breen et al. | 110/347 |

OTHER PUBLICATIONS

"Coal Fired Precombustors for Simultaneous $NO_x$, $SO_x$, and Particulate Control" G. C. England, J. F. La Fond and R. Payne, EPA/EPRI Stationary Source $NO_x$Symposium, Boston, May, 1985.

*Primary Examiner*—Edward G. Favors

*Attorney, Agent, or Firm*—Buchanan Ingersoll

[57] ABSTRACT

An improved method for burning carbonaceous material containing sulfur to reduce emissions of $SO_2$ is disclosed wherein the carbonaceous material is projected into a furnace as one or more streams and each stream is continuously ignited with a volatile fuel such as natural gas, oil, liquefied petroleum gas or naptha. The volatile fuel is supplied separately from the carbonaceous material and is directed into each stream of the carbonaceous material as it enters the furnace so as to cause the material to be enveloped in a reducing atmosphere during its volatilization. In consequence, at least a portion of the sulfur contained in the carbonaceous material is retained within the ash slag in its reduced or sulfide form.

12 Claims, 1 Drawing Sheet

METHOD OF RETAINING SULFUR IN ASH DURING COAL COMBUSTION

BACKGROUND OF THE INVENTION

1. Field of Invention

The present invention relates to a method for the combustion of coal wherein the emissions of $SO_2$ are reduced.

2. Description of the Prior Art

In the combustion of carbonaceous materials such as coal which contains sulfur and ash, oxygen may combine with the sulfur to produce sulfur dioxide. Production of sulfur dioxide is undesirable. Government regulations limit the amount of sulfur dioxide which may be emitted from a combustion furnace. To comply with these regulations, utilities generally have elected to use low sulfur coals or to use alternate fuels such as oil and gas or to use expensive scrubbers. Low sulfur coals may be more expensive than coals with higher sulfur content or may incur logistic and/or transport expense. Because of this price difference, numerous attempts have been made to develop processes for burning coals of higher sulfur content without producing increased emission of sulfur dioxide.

The art has pursued at least two methods of burning coal to reduce sulfur emissions. One process involves the addition of a reagent, such as limestone, to the coal. In many furnaces, coal is pulverized and injected into the combustion chamber in powder form. Prior to, during or after the injection of coal into a furnace, limestone or other reagents are mixed with the coal. The reagent provides a material, such as calcium oxide, which will combine with sulfur dioxide formed during combustion. In that way emission of sulfur dioxide is reduced.

A second method is simply to dilute the coal with another fuel that contains no sulfur. One example would be to inject gas or low sulfur oil into the combustion chamber along with powdered coal. It has generally been believed that the reduction in sulfur dioxide emissions in the flue gases would be proportional to the reduction in overall percentage of sulfur content of the combined fuels. If a coal containing 0.5 percent sulfur were combined with natural gas that contains no sulfur to form a fuel that is 90 percent coal and 10 percent gas, the sulfur content of the resulting fuel would be 0.45 percent based on the heat of combustion. This method has generally not been followed because coal prices are substantially less than the prices of gas and oil. Thus, there is little cost benefit in combining these fuels to significantly reduce sulfur dioxide emissions.

There have also been numerous methods proposed for removing sulfur dioxide from the gases escaping from the combustion process. The most common commercial practice is to scrub the flue gas with lime or limestone sprays or solutions which effectively removes the sulfur dioxide. This scrubbing process is very expensive.

All of these prior art methods have disadvantages. A principal problem is that most coal furnaces which are now in operation are not designed to accommodate any of these techniques, and major modifications are required to utilize these methods. Such retrofitting is expensive. Consequently, there is a need for a coal combustion process which will reduce sulfur dioxide emissions and which can be readily used in existing coal furnaces.

The use of reagents, as well as substitution of alternate fossil fuels, increases the costs of the combustion process. Unless these increases can be offset with the use of low cost, high sulfur coal, these methods increase the cost of power generation. Accordingly, there is a need for a process that will enable one to burn low cost, higher sulfur, non-compliance fuels and provide a net savings over conventional methods.

SUMMARY OF THE INVENTION

In accordance with the present invention there is provided a process for combining a carbonaceous material, such as coal or petroleum coke, with small amounts of a volatile fuel, such as natural gas, in the combustion chamber. This fuel is used in such an amount and location as to improve the ignition and stabilization of the coal flame front and envelope the coal stream in reducing combustion gases. Specifically, the volatile fuel is directed so that it impinges on a stream of pulverized coal as it enters the furnace at the burner. This can be done by using gas ignitors of the type found in some furnaces and easily added to other furnace not so originally equipped. By using this method, at least a part of the sulfur content of the pulverized carbonaceous material tends to be retained in its reduced state in the combustion ash and slag particles and thus sulfur dioxide emissions can be reduced between two and three times that expected from simply diluting coal with a sulfur free, combustible gas. This process is readily adaptable to many conventional coal fired furnaces without major modifications. Many furnaces have gas jets for injecting natural gas into a furnace.

These jets have conventionally been used only for preheating the furnace or for ignition during start-up of the furnace.

Those furnaces which do not have gas jets can easily be fitted with gas jets at a relatively low cost.

In addition to reducing sulfur dioxide emissions, our process provides a net savings in fuel costs. The process enables one to use coals having higher sulfur contents which are lower in price. Although the gas used in the process is more expensive than all types of coal, the amount of gas employed in the invention is a relatively small percentage of the total combustible materials. As a consequence, the combined cost of the high sulfur coal and gas is often less the cost of a lower sulfur coal which would release the same amount of heat and produce the same level of sulfur dioxide emissions. Other objects and advantages of the invention will become apparent as a description of the preferred embodiments proceeds.

DESCRIPTION OF THE PREFERRED EMBODIMENTS

Before describing the method of the present invention the pertinent physical activity and chemical reactions which occur in a furnace will be reviewed. It is well-known that sulfur will react differently at different temperatures and amounts of theoretical air. It is also known that when sulfur combines with calcium, iron or magnesium in a reducing atmosphere within a furnace to form CaS, FeS or MgS, the resultant sulfide compounds may remain in the slag. As a result, the reduced sulfides which are formed in a reducing atmosphere will not be readily available to form sulfur dioxide. Also, sulfur can combine with calcium in an oxidizing atmosphere to form $CaSO_4$. Since all sulfur has the potential of forming sulfur dioxide, the percent of sulfur which has reacted with calcium and other metals and is retained in the slag or ash can be properly considered to be the percent of sulfur dioxide removed from the system. Thus, furnace conditions which form and/or preserve sulfides and sulfates serve to avoid sulfur dioxide formation in the stack gases. Our method uses a volatile fuel to enhance these beneficial reactions, thereby reducing the formation and release of sulfur dioxide into the stack gases.

Figure 2:
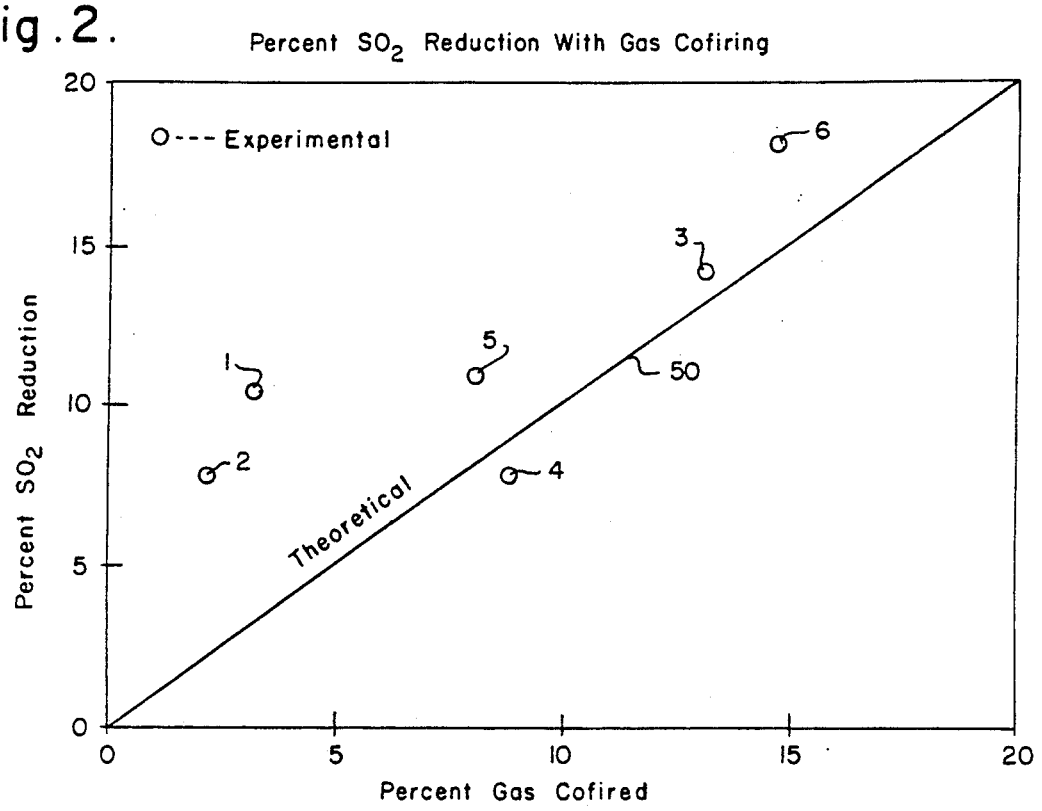
FIG. 2 is a chart showing the actual sulfur retention observed with the present method.
Figure 1:
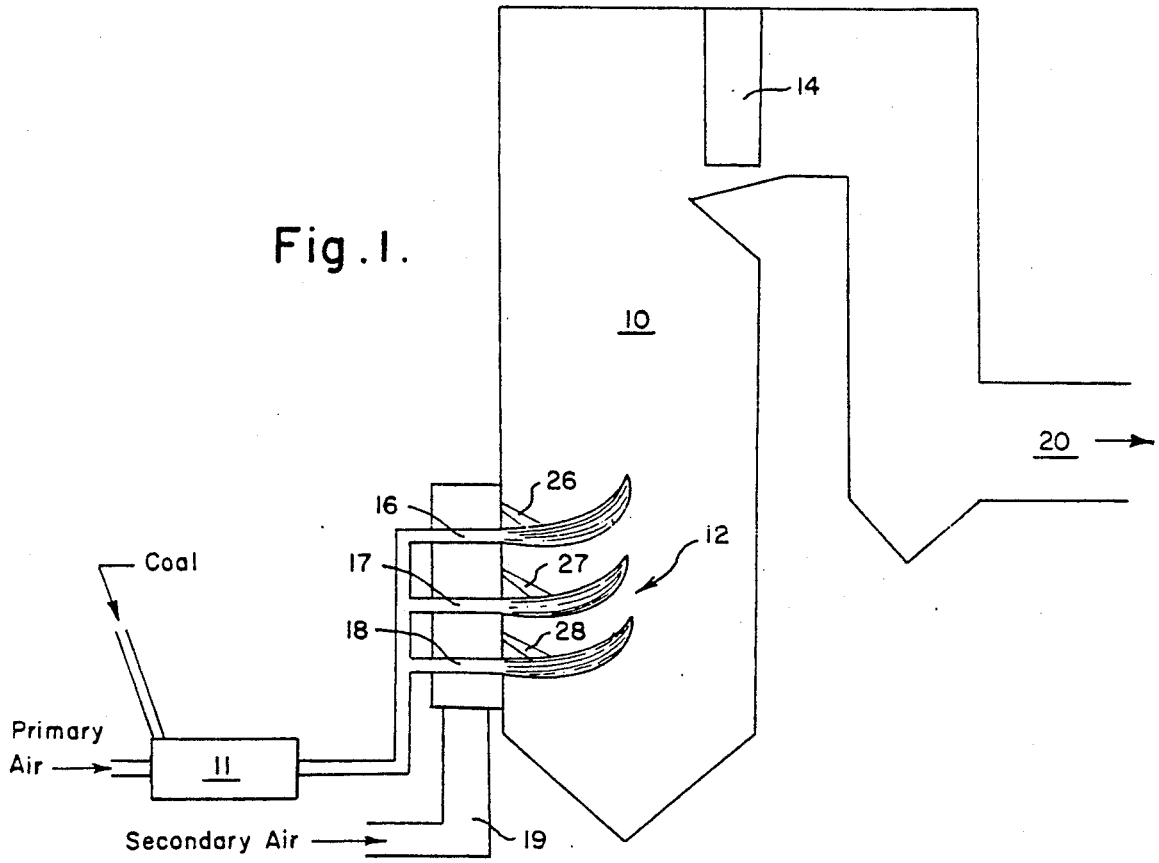
FIG. 1 is a schematic drawing of our process applied to a boiler.

FIG. 1 shows a schematic drawing of a furnace 10 having a combustion zone 12 and a heat exchanger 14 consisting of furnace water walls and lower temperature convective tubes. Coal is conveyed and injected into the furnace through inlets 16, 17 and 18. Typically, the coal has been finely pulverized in mill 11 and is conveyed in a stream of primary air into furnace 10 through inlets 16, 17, 18. The coal enters the furnace through an inlet of a burner where it ignites to produce a main flame in combustion zone 12. Secondary air may be provided to the burners through pipe 19. Most furnaces have several burners in an array arranged to project multiple coal streams into a combustion zone 12. When the coal reaches combustion zone 12 it ignites and burns. Escaping gases from the combustion process pass through heat exchanger 14 and exit as flue gas through opening 20. To utilize the present method, gas jets 26, 27 and 28 are provided for each coal inlet 16, 17 and 18. Each gas jet is positioned so as to inject a volatile fuel such as natural gas, liquid petroleum gas, naphtha or oil into each coal stream emanating from the inlets 16, 17, 18 as it enters the furnace. The velocity and direction of the fuel stream is such that it does not disperse the coal stream or disrupt the integrity of the coal stream. Typically, in prior art furnace operations, the first ten feet of the coal stream within the furnace is in a high temperature (adiabatic) oxidizing environment because the coal fuel has not fully volatilized. Thus, the sulfur contained in the coal particles which contain pyritic sulfur and various forms of sulfide and sulfate in both the organic and inorganic state tend to be oxidized so that the sulfur, which these particles contain, becomes gaseous sulfur dioxide which reports to the flue gas and which sulfur dioxide is thereafter very difficult and expensive to remove. Subsequent to the initial oxidizing zone is the combustion zone 12 where combustion of the volatilized coal occurs. In accordance with the present invention a volatile fuel is injected through jets 26, 27 and 28 into that initial oxidizing region and serves to anchor the flame, to reduce the theoretical air available for combustion particularly within the directed coal/gas stream and to thereby form a reducing atmosphere enveloping the coal therewithin, and to dilute the coal fuel. In a preferred embodiment of the invention the integrity of the coal/gas stream is maintained for a distance of at least ten feet from the point of injection of the coal stream into the furnace. In a furnace similar to that illustrated in FIG. 1, we have injected gas through ignitors and warm-up guns in varying quantities to provide up to 15 percent of the total heat released. Based on the heat contents of the fuels, we expected a direct relationship between the percentage of gas utilized and the reduction in sulfur dioxide emissions. For 5 percent gas component of the combined fuels, we expected approximately a 5 percent reduction in sulfur dioxide emissions. However, in practice we discovered that the reduction in sulfur dioxide was higher than expected. In FIG. 2, we have graphed the percent of gas component in the combined fuels based on heating value against the percent sulfur dioxide reduction. Line 50 on the graph of FIG. 2 represents the theoretical amount of sulfur dioxide reduction expected for simple dilution. The points represents the actual reductions. These points have values taken from the following table of data from six examples of furnace operations which we observed. The points are numbered with the appropriate example numbers from the table below.

$SO_2$ REDUCTION WITH NATURAL GAS

| EXAMPLE | TEST NUMBER | LOAD, MW (ELECTRICAL) | NATURAL GAS % OF HEATING VALUE OF FUEL | $SO_2$ EMISSION, $LB^2/10^6$ BTU | $SO_2$ REDUCTION, % |
|---|---|---|---|---|---|
| 1 | 25 | 599 Constant | 0 | 2.40 | — |
| | 26 | 598 Load | 3.2 | 2.15 | 10.4 |
| 2 | 46 | 567 Constant | 0 | 2.55 | — |
| | 47 | 563 Load | 2.2 | 2.35 | 7.8 |
| 3 | 50 | 568 Constant | 0 | 2.62 | — |
| | 51 | 569 Load | 13.1 | 2.25 | 14.1 |
| 4 | 52 | 503 Load | 0 | 2.70 | — |
| | 53 | 520 Increased | 8.8 | 2.49 | 7.8 |
| 5 | 55 | 523 Load | 0 | 2.75 | — |
| | 56 | 563 Increased | 8.1 | 2.45 | 10.9 |
| 6 | 61 | 496 Load Increased | 0 | 2.55 | — |
| | 62 | 561 With Gas | 1.47 | 2.08 | 18.4 |

The table shows the test numbers, the unit load, the natural gas used, the $SO_2$ emissions and the $SO_2$ reduction. The percent of natural gas used and $SO_2$ reduction are shown as data points in FIG. 2. The expected percentage $SO_2$ reduction would be the same as the percentage of heat supplied by natural gas as shown by line 50 in FIG. 2. In example 2, only 2.2% of the heating value was supplied by natural gas and the $SO_2$ was reduced 7.8%. In example 1, only 3.2% of the heating value was supplied by natural gas. However, the $SO_2$ reduction realized was 10.4%. Examples 1 and 2 show the greatest leverages or increase beyond the expected. They were the tests with the least gas which was injected only through ignitors. In the other examples, about 3.5% of the heating value was injected as natural gas through the ignitors and the balance of the natural gas entered through furnace warm-up guns. That additional gas injected through the warm-up guns was not directed into the region where coal entered the furnace and hence did not participate in altering the initial oxidizing zone environment or coal combustion. The ignitors, on the other hand, directed the gas at the coal streams as they entered the furnace, altered the initial oxidizing atmosphere enveloping the coal to a reducing atmosphere and increased sulfur retention. This data reveals that to achieve significant $SO_2$ reduction, the gas flames should impinge and interact with the coal streams as they enter the furnace.

As can be seen from the table and the graph, sulfur dioxide emissions were reduced beyond the theoretical level. The most dramatic reductions occurred in Examples 1 and 2. In these examples, all of the gas was introduced through ignitors into the coal stream as it entered the furnace. In examples 3, 4, 5 and 6 where much of the gas entered through the warm-up guns and which gas was not, therefore, directed at the coal streams, the reductions were not so large. Consequently, to achieve significant reduction of $SO_2$ emissions, the gas should be directed to the coal stream as it enters the furnace as was done by the ignitors. Injecting gas into other parts of the combustion zone, as was done with the warm-up guns, does not provide sulfur reduction beyond that expected by dilution.

The difference between the amount of sulfur reduction expected by dilution and the actual reduction in sulfur emissions is sulfur that has been retained in the bottom ash or slag. We have found that this sulfur will remain in the slag until the slag is removed if two additional conditions are met. First, one must prevent the slag from oxidizing. Second, the temperature of the slag should not exceed 2,600° F.

While we have shown certain present preferred embodiments of the invention, it is to be understood that the invention is not limited thereto, but may be variously embodied within the scope of the following claims.

We claim:

1. An improved method of burning carbonaceous material containing sulfur comprising: projecting at least one stream of carbonaceous material containing sulfur into a combustion zone of a furnace and burning said carbonaceous material therein; continuously igniting each said stream of carbonaceous material with a volatile fuel supplied separate and apart from said carbonaceous material, said volatile fuel being directed into said carbonaceous material stream as it enters said furnace in a manner so as to cause the carbonaceous material to become enveloped in a reducing atmosphere during volatilization thereof and without disrupting the integrity of the stream of carbonaceous material.

2. The method of claim 1 wherein the integrity of each stream of carbonaceous material in the reducing atmosphere is maintained to a distance of at least ten feet from the entry of said stream into the furnace.

3. An improved method for burning carbonaceous material containing sulfur which comprises: projecting at least one stream of carbonaceous material containing sulfur into the combustion zone of a furnace and burning said carbonaceous material therein to produce, inter alia, a bottom ash; continuously igniting each said stream of carbonaceous material with a volatile fuel supplied separate and apart from said carbonaceous material, said volatile fuel being directed into said carbonaceous material stream in a manner so as to cause the carbonaceous material to become enveloped in a reducing atmosphere during volatilization thereof and without disrupting the integrity of the stream of carbonaceous material; and removing bottom ash containing retained sulfide from said furnace while preventing the ash from oxidizing and from reaching a temperature above 2,600° F.

4. The method of claim 1 also comprising the step of removing bottom ash containing retained sulfide while preventing the ash from oxidizing and from reaching a temperature above 2,600° F.

5. The method of claim 1 also comprising the step of controlling primary air in a manner to optimize the sulfur retention characteristics of the volatile fuel reducing zone atmosphere for the carbonaceous material.

6. The method of claim 1 wherein the direction and flow of said volatile fuel supplied to each carbonaceous material stream is adjustable to allow optimization of sulfur retention.

7. The method of claim 1 wherein the carbonaceous material is coal.

8. The method of claim 1 wherein the carbonaceous material is petroleum coke.

9. The method of claim 1 wherein the volatile fuel is natural gas.

10. The method of claim 1 wherein the volatile fuel is liquified petroleum gas.

11. The method of claim 1 wherein the volatile fuel is naphtha.

12. The method of claim 1 wherein the volatile fuel is oil.

* * * * *

UNITED STATES PATENT AND TRADEMARK OFFICE

CERTIFICATE OF CORRECTION

PATENT NO. : 5,042,404

DATED : August 27, 1991

INVENTOR(S) : RICHARD C. BOOTH, BERNARD P. BREEN, ROGER W. GLICKERT

It is certified that error appears in the above-identified patent and that said Letters Patent is hereby corrected as shown below:

Column 2, line 24, change "furnace" to --furnaces--.

Column 2, line 48, after "less" insert --than--.

Signed and Sealed this

Fifteenth Day of December, 1992

*Attest:*

DOUGLAS B. COMER

*Attesting Officer*

*Acting Commissioner of Patents and Trademarks*